US007195048B2

(12) United States Patent
Wojtkun et al.

(10) Patent No.: US 7,195,048 B2
(45) Date of Patent: Mar. 27, 2007

(54) ADHESIVE FILM DISPENSER

(75) Inventors: Thomas Wojtkun, Lakewood, OH (US); Dominic Daunter, Howell, MI (US); David Thimm, Plymouth, MI (US); Curt Bailey, Birmingham, MI (US); James Hawley, Sheffield Village, OH (US); Brian Vulpitta, Avon Lake, OH (US)

(73) Assignee: Henkel Consumer Adhesives, Inc., Avon, OH (US)

( * ) Notice: Subject to any disclaimer, the term of this patent is extended or adjusted under 35 U.S.C. 154(b) by 28 days.

(21) Appl. No.: 10/454,000

(22) Filed: Jun. 4, 2003

(65) Prior Publication Data

US 2004/0244917 A1 Dec. 9, 2004

(51) Int. Cl.
*B32B 37/22* (2006.01)

(52) U.S. Cl. ..... 156/527; 156/576; 156/577; 156/579

(58) Field of Classification Search ..... 156/523, 156/527, 576, 577, 579; 225/19, 20, 56, 225/77, 91; D19/67
See application file for complete search history.

(56) References Cited

U.S. PATENT DOCUMENTS

| | | | | |
|---|---|---|---|---|
| 3,586,587 A | | 6/1971 | Boyce | |
| 3,709,760 A | * | 1/1973 | Knoner | 156/527 |
| 3,954,550 A | * | 5/1976 | Patterson | 156/486 |
| 3,969,180 A | * | 7/1976 | Ravesloot | 156/523 |
| 4,096,021 A | * | 6/1978 | Pool et al. | 156/527 |
| D256,478 S | * | 8/1980 | Groff | D19/67 |
| 4,486,263 A | | 12/1984 | Monzo Gomez | |
| 4,555,298 A | * | 11/1985 | Boucher | 156/523 |
| 4,574,030 A | * | 3/1986 | Pilcher | 156/522 |
| D283,631 S | | 4/1986 | Miller et al. | |
| 4,591,407 A | | 5/1986 | Samuelson | |
| 4,762,586 A | | 8/1988 | Wilkie | |

(Continued)

FOREIGN PATENT DOCUMENTS

EP 0 409 532 A1 1/1991

(Continued)

OTHER PUBLICATIONS

3M Home and Leisure: Scotch™ Colored Plastic Tapes (Internet Web Page), 3M, St. Paul, Minnesota.*

*Primary Examiner*—Mark A. Osele
(74) *Attorney, Agent, or Firm*—Conolly Bove Lodge & Hutz LLP

(57) ABSTRACT

An ergonomic dispenser of a roll of adhesive film facilitates application of that film to a surface with minimum manipulation by the user. The dispenser has a low profile where the cutting blade, axis of rotation of the adhesive film roll and dispenser handle lie in closely aligned planes. This creates a low profile dispenser which places the roll of adhesive film in close proximity to the application surface. A flexible shield overlies the cutting blade to prevent unwanted user contact with the blade. Various means are used to manage the loose end of film after it is cut off the roll so that it does not adhere to the roll or double over on itself. Unidirectional movement of the roll is also used to manage the loose end of tape after cutoff. Optionally, blade means may be added to the dispenser's handle for use in opening cartons, cutting string or the like.

7 Claims, 4 Drawing Sheets

U.S. PATENT DOCUMENTS

| | | | | |
|---|---|---|---|---|
| 4,804,437 | A | | 2/1989 | Tirtoprodjo et al. |
| 4,818,329 | A | | 4/1989 | Tutas et al. |
| 4,853,073 | A | * | 8/1989 | Marchetti ..... 156/510 |
| 4,944,720 | A | | 7/1990 | Suhr |
| 4,961,525 | A | | 10/1990 | Corbo et al. |
| 4,989,769 | A | | 2/1991 | Longworth |
| 5,022,576 | A | * | 6/1991 | Jenq ..... 225/20 |
| 5,073,228 | A | | 12/1991 | Lin |
| D326,475 | S | | 5/1992 | Alexander |
| 5,110,401 | A | | 5/1992 | Huang |
| 5,181,983 | A | | 1/1993 | Sakai |
| D338,041 | S | | 8/1993 | Cheng |
| 5,363,997 | A | | 11/1994 | Harris |
| 5,380,395 | A | * | 1/1995 | Uchida ..... 156/577 |
| 5,393,367 | A | | 2/1995 | Yu Chen |
| 5,456,790 | A | | 10/1995 | Yu Chen |
| 5,468,332 | A | | 11/1995 | Dretzka et al. |
| 5,641,377 | A | | 6/1997 | Chung et al. |
| D401,281 | S | * | 11/1998 | Huerta ..... D19/69 |
| 5,849,144 | A | | 12/1998 | Tang et al. |
| 5,851,348 | A | | 12/1998 | Muenzer et al. |
| 5,857,706 | A | * | 1/1999 | McQueeny ..... 281/29 |
| 5,861,080 | A | | 1/1999 | Yang et al. |
| 5,890,290 | A | * | 4/1999 | Davis ..... 30/2 |
| D412,820 | S | | 8/1999 | Lee |
| 5,954,916 | A | | 9/1999 | Orlandi |
| D416,288 | S | | 11/1999 | Kuehn |
| 6,039,102 | A | | 3/2000 | Sadrakula et al. |
| 6,098,690 | A | | 8/2000 | Robichaud |
| D433,062 | S | | 10/2000 | Ho |
| 6,152,398 | A | | 11/2000 | Chen |
| D445,661 | S | | 7/2001 | Chen |
| 6,257,298 | B1 | | 7/2001 | Huang |
| D448,413 | S | | 9/2001 | Carlson et al. |
| D448,414 | S | | 9/2001 | Carlson |
| 6,296,033 | B1 | | 10/2001 | Clements |
| D454,911 | S | | 3/2002 | Carlson et al. |
| D463,825 | S | | 10/2002 | Carlson et al. |
| 6,478,067 | B1 | | 11/2002 | Huang |
| 6,491,082 | B1 | | 12/2002 | Fu |
| 6,641,081 | B2 | * | 11/2003 | Huang ..... 242/588 |
| 6,848,489 | B2 | | 2/2005 | Lissoni |
| 2004/0089424 | A1 | | 5/2004 | McDonald |

FOREIGN PATENT DOCUMENTS

| | | |
|---|---|---|
| FR | 2 060 887 A | 6/1971 |
| JP | 68 047755 | 3/1983 |
| JP | 06 016321 | 1/1994 |
| JP | 09 208114 | 8/1997 |

* cited by examiner

Fig. 7.
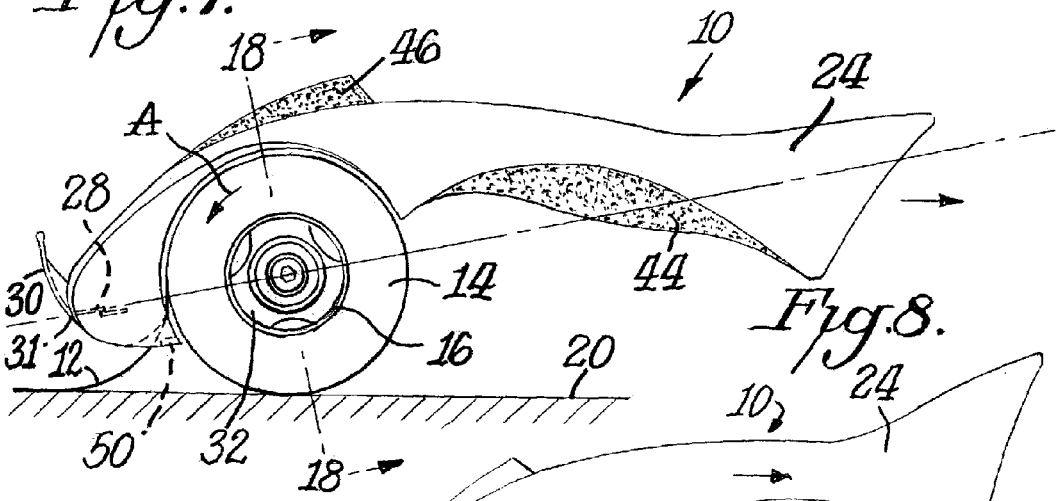
Fig. 8.
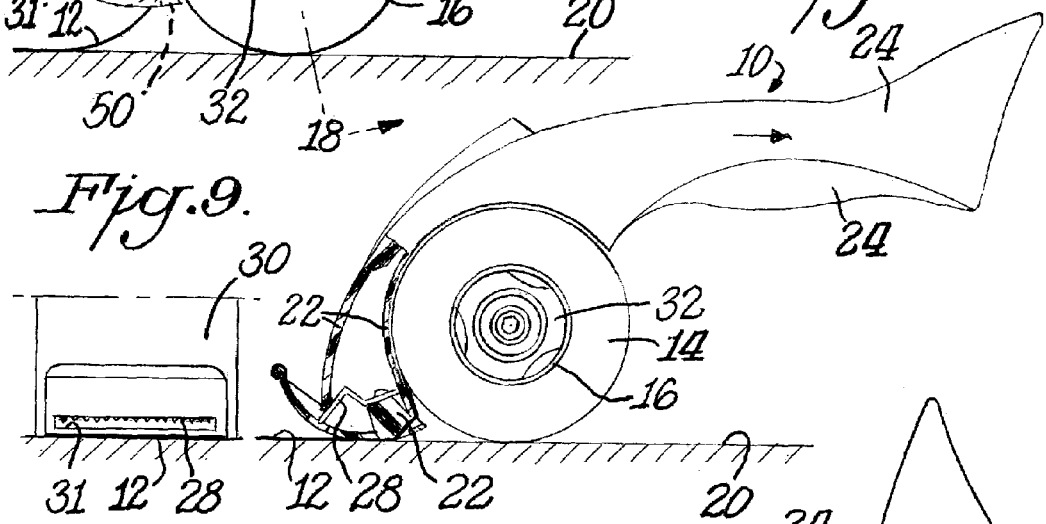
Fig. 9.
Fig. 10.
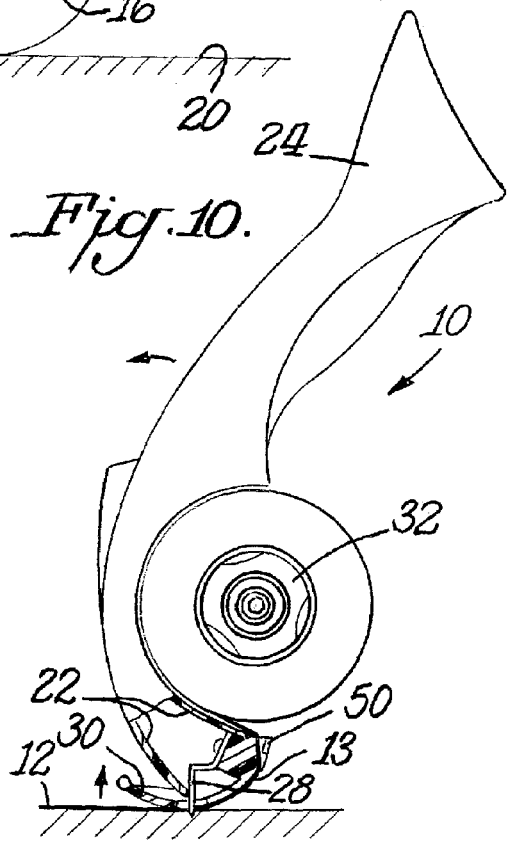
Fig. 11.
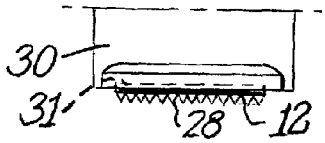

ADHESIVE FILM DISPENSER

BACKGROUND OF THE INVENTION

Numerous types of adhesive film dispensers are currently in use ranging from relatively simple single use dispensers as shown in Corbo, et al., U.S. Pat. No. 4,961,525 to devices used by bulk mailers of packages such as Clements U.S. Pat. No. 6,296,033.

The latter category of dispenser is characterized by a pistol grip handle having a bulky roll of tape above it and a dispensing mechanism, including cutting blade, jutting out at about 90° or greater from a plane which passes through the handle and centerline of the tape. This type of dispenser features a triangular orientation of tape, handle and cutting blade. Other examples of such "pistol grip" adhesive film dispensers are described in U.S. Pat. Nos. 6,491,082; 6,478,067; 6,296,033; 6,257,298; 6,098,690; 5,954,916; 5,849,144; 5,456,790; 5,393,367; 5,110,401; 4,804,437; 4,818,329; 4,762,586 and other patents.

Pistol grip dispensers, however, are not ergonomic devices. They are typically top heavy with much of the weight in the forward part of the device, outside the axis of the handle. This tends to pull the device forward when held by applicator, adding to wrist and arm strain of the user. In addition, the angle of adhesive film application from pistol grip dispensers is awkward. More specifically, the pistol grip dispenser must be rotated through an arc of about 60–90° each time the adhesive film is applied to a surface. To cut the tape, the dispenser typically must be rotated another 30–60° to force the cutting blade into severing contact with the film or tape to be cut. See FIG. 1 and column 3, lines 60 et. seq. of U.S. Pat. No. 6,296,033.

Existing adhesive film dispensers can also inflict other harm on users, for example, cuts arising from user contact with the cutting blade. Several different approaches for limiting such harm appear in existing patents.

Among those approaches is that described in Clements U.S. Pat. No. 6,296,033 which discloses a removable guard formed from a pliable material which is removably attached to, and extends beyond, the cutting blade. The extended length of the guard beyond the outer edge of the cutting blade limits impact of the blade on objects and the user. (See FIG. 3 and column 3, lines 28–40). The Clements patent also discloses use of a less pliable guard which is scored along a bendline to form a resilient hinge (See column 3, lines 40–44). The guard is moved out of its guarded position over the serrated blade by the tape as it is drawn off the tape roll and toward contact with the blade. The tape pulls the shield away from the blade to facilitate the latter's penetration of the tape. (See FIG. 4 and column 3, lines 60, et seq.).

Another approach to shielding a user from the cutting edge of a tape dispenser is disclosed in Chen, et al. U.S. Pat. Nos. 5,456,790 and 5,393,367. These patents disclose a rigid pivoted shield that is normally biased into a protective position over the cutting blade. The shield is pivoted out of its protective position when the tape dispenser is tilted to dispense tape, thereby allowing cutting engagement of the blade with the tape (See FIGS. 5–6 and column 4, lines 42–47 of the '790 patent).

Other patents approach the problem of sharp cutting blades with mechanisms that retract the blade until it is needed to cut the tape. In Chung, et al. U.S. Pat. No. 5,641,377, a hand held dispenser employs a mechanism which extends the blade when pressure is applied on a pivoting "wiper" extending from the body of the dispenser (See FIGS. 2–3 and column 4, lines 49 et seq.). A very similar arrangement for a retractable blade is disclosed in Tang, et al. U.S. Pat. No. 5,849,144.

U.S. Pat. No. 4,818,329 issued Apr. 4, 1989 to Tutas, et al. discloses a rigid, spring-biased movable guard over a cutting blade mounted on a rotatable shaft which is normally spring biased to cover the blade but can be rotated out of its covering position when the dispenser is rotated into position to dispense tape (See FIGS. 2–3 and column 7, lines 2049).

Yet another approach to limiting contact with a dispenser blade is illustrated in commonly assigned U.S. Provisional Application Ser. No. 60/425,006 filed Nov. 9, 2002. This application describes a frame on which a roll of tape is rotatably mounted. A shield extending from the frame and parallel to the cutting blade minimizes user contact with the blade. The shield either extends beyond the edge of the blade or in close proximity thereto, thereby protecting the user.

Another issue with other adhesive film dispensers is the management of the film after it is cut. If the loose end of film, after it is cut from the roll, is not properly managed the sticky side of the tape can double over on itself with consequent detriment to future application of tape on surfaces to be taped. Or the loose end of the film or tape can rewind onto the tape roll before the dispenser can be used. One approach to management of loose ends of tape or film after being cut from the roll is multiple tabs surrounding the loose end of the tape as it is unwound. Suhr U.S. Pat. No. 4,944,720 discloses such tabs (reference number 40 in FIG. 2) whose function is described at column 1, lines 33–43. Guide rollers in FIG. 2 of Chen U.S. Pat. No. 6,152,398 are also designed to hold the loose end of tape in place so that it may be easily applied to the next article to be taped (column 2, lines 11–15).

SUMMARY OF THE INVENTION

The adhesive film dispenser of this application exhibits a substantially improved ergonomic shape that facilitates both laydown and cutting of film with reduced physical impact on the user. The three principal elements of this dispenser, i.e., handle, axis of tape roll and cutting blade are, unlike the above described devices, aligned in substantially the same plane. This alignment facilitates placement of the adhesive film on the desired application surface with minimal rotation of the dispenser. This result is better enabled because the tape roll is very close to the application surface when the dispenser is held by the user. By contrast, in the prior art pistol grip dispensers the adhesive film or tape roll is located a distance from the application surface at least equal to the length of the handle. That distance of roll from surface contributes to the awkward rotation of the prior art pistol grip devices.

When the dispenser disclosed in this application is held in a normal manner by the user, the tape roll is immediately adjacent the application surface and ready for use with little or no rotation of the dispenser.

When the desired amount of tape is applied to an application surface and is to be cut, the dispenser need only be rotated a few degrees for a few seconds to allow contact of a cutting blade with the tape. This rotation is guided by a flexible, curvilinear cutting blade shield extending along the forward end of the dispenser frame. This curvilinear shield also performs other functions in addition to protecting a user from contact with the dispenser's cut off blade. It acts as a surface for burnishing the end of the tape as it is applied to the application surface just before being cut off from the roll. It also can contain one or more features that manage the loose end of the adhesive film or tape after it is cut off from the roll. Among those features for holding the loose tape end in place are: miniature depressions or dimples on a portion of the shield that act as suction cups; a portion of the shield that generates enough static electricity to hold the tape in place between applications; and various low tension adhesive coatings.

To further improve management of the loose tape end, the tape roll carrier contains a mechanism that prevents counter-rotation of the tape roll. A ratchet mechanism associated with the tape carrier allows the tape to rotate in only one direction, namely, the direction in which tape is applied to the application surface. Thus, after the tape is cut off, there is no counter-rotation or backlash of the roll that would pull the loose end of the tape back into contact with the roll.

The dispenser of this invention works best with tape rolls having a relatively small (1 to 1½) inch core but other core sizes can be used. A tape roll having a core approximating one-and-a-half inches facilitates many of the ergonomic and operational features just described.

An optional feature of this adhesive film dispenser is inclusion of a cutting blade in the handle. This cutting blade is preferably tucked into the end of the handle in a manner that facilitates its use to open cartons, cut string and the like, but is not dangerous to the user of the dispenser. Commonly assigned U.S. Provisional Patent Application Ser. No. 60/425,586 filed Nov. 12, 2002 discloses such a combined tape dispenser and cutting tool.

BRIEF DESCRIPTION OF THE DRAWINGS

FIG. 7 is a side elevational view of the dispenser showing in phantom the alignment of the principal parts of the dispenser, namely, the axis of the tape roll, handle and cutting blade;

FIG. 8 is a side elevational view of the dispenser in position for pressing tape onto an application surface;

FIG. 9 is a fragmental view of the dispenser showing the cutter blade in position above the tape before cutting thereof;

FIG. 10 is a side elevational view of the dispenser in position to cut tape after application;

FIG. 11 is a fragmental view of the dispenser showing the cutter blade as it extends through the shield to cut the tape;

DETAILED DESCRIPTION

Figure 21:
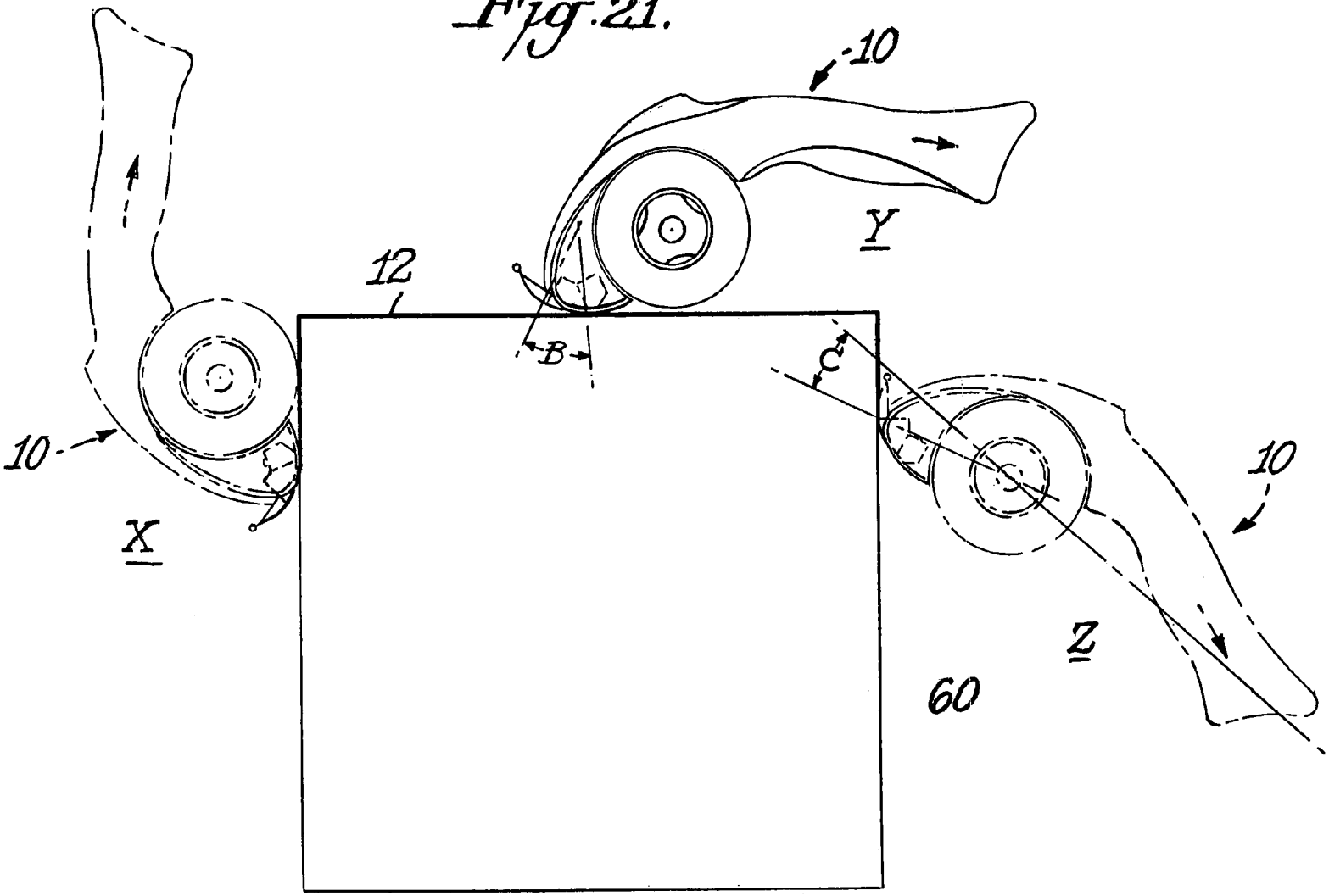
FIG. 21 is a schematic diagram showing the tape dispenser of the inventors in varying positions as tape is applied to a box, including phantom outline of the dispenser in some positions.

The adhesive film dispenser 10 is configured for ergonomic application of adhesive film or tape 12 from a roll 14 onto an application surface 20 (See FIGS. 7, 8 and 21). The tape 12 is typically wound around a cardboard core 16 in a well known manner. The dispenser 10 is particularly useful in dispensing tape 12 wound on a 1½ inch core versus the more typical core size of 3 inches used in most pistol grip dispensers such as those described above. The smaller core size enhances the ergonomic features of adhesive film dispenser 10. The reduced core size enables a lower profile dispenser where the roll 14 skims surface 20 during application of the tape (See FIGS. 9 and 21). By mounting the tape roll 14 in line with the dispenser handle, rather than atop the handle as was done in the prior art, application of tape is eased.

The dispenser 10 is formed around an underlying frame 22 (See. FIG. 8) and generally comprises a handle 24 at one end of the frame 22, a mandrel 26 in the middle about which the tape roll 14 turns (See FIG. 18), and a cutting blade 28 at the other end which is also mounted on the frame 22. Also attached to frame 22 of dispenser 10 is a flexible, curvilinear shield 30 which protects the user from exposure to cutting blade 28 in a manner described below.

To maintain the desired ergonomic profile, these three components of dispenser 10, namely, handle 24, mandrel 26 and blade 28 are preferably aligned along a plane passing through these components, as illustrated by the phantom line in FIG. 7. This substantially straight line arrangement of key components facilitates the low, streamlined profile of dispenser 10. That arrangement puts the tape in a logical position between handle and blade, rather than atop the handle as is typically done with pistol grip dispensers. A relatively straight line alignment of these components is preferred, although a slight angulation of the blade 28 relative to a plane passing through the handle and axis of the tape roll can also be used. This angulation, labeled as "C" in FIG. 21, is preferably less than 30°. However an angle "C" of 0° to 60° can be used while preserving the advantages of dispenser 10.

Figure 4:
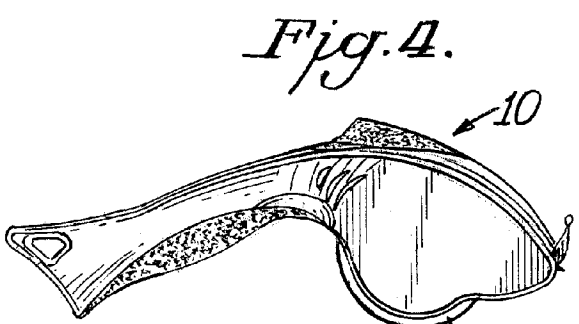
FIG. 4 is a left side elevational view thereof.
Figure 3:
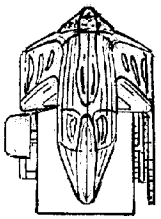
FIG. 3 is a rear elevational view thereof.
Figure 5:
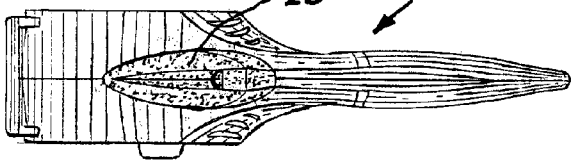
FIG. 5 is a top plan view thereof.
Figure 2:
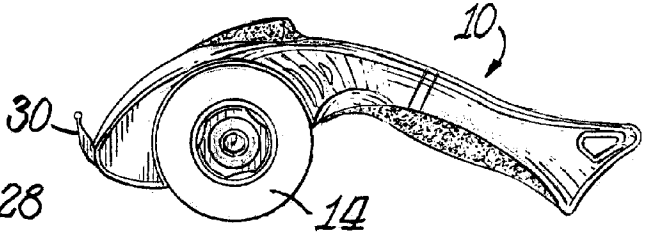
FIG. 2 is a right side elevational view thereof.
Figure 1:
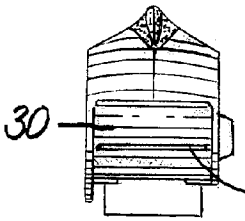
FIG. 1 is a front elevational view of an adhesive film dispenser according to the present invention.
Figure 6:
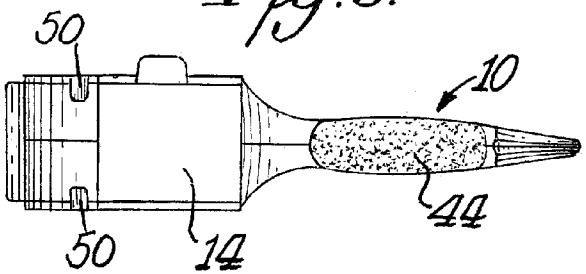
FIG. 6 is a bottom plan view thereof.
Figure 18:
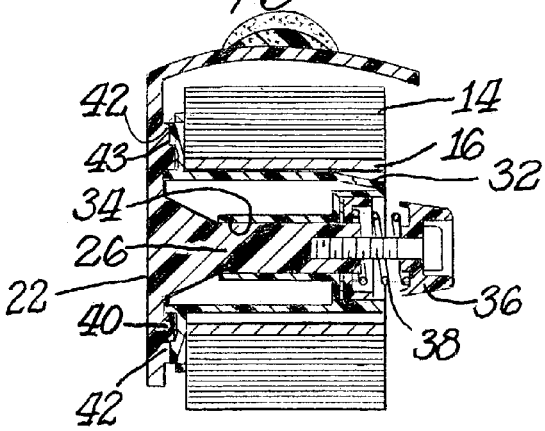
FIG. 18 is a cross-sectional view in elevation along line 18—18 of FIG. 7 showing the tape roll core mounting assembly including a counter-rotation ratchet mechanism.

The tape roll 14 can be mounted on dispenser 10 in a manner that facilitates adjustment of the roll's freedom to rotate in dispenser 10. As shown in FIG. 18, mandrel 26 is attached to frame 22 and forms the axis about which the roll 14 turns. Its freedom to turn can be adjusted by conventional tensioning means such as those described in FIG. 2 of Huang U.S. Pat. No. 5,110,401. Such means as used in the dispenser 10 are illustrated in FIG. 18. They include a tape roll carrier 32 which is dimensioned to be slightly larger in outside diameter than the inside diameter of tape core 16. This interference fit between tape core 16 and tape roll carrier 32 limits slippage of the tape roll 14 relative to the carrier 32. A bore 34 in carrier 32 rotates on mandrel 26. The freedom of tape roll carrier 32 to move relative to the mandrel 26 can be adjusted using adjustment knob 36 and spring 38 in a manner described as "prior art" in U.S. Pat. No. 5,110,401 mentioned above.

It has been found helpful to limit the rotation of tape roll 14 to one direction in order to properly manage the loose end of the adhesive film after it is cut from the roll. More particularly, it is desirable to have roll 14 always rotate in the direction in which tape is dispensed (Arrow "A" in FIG. 7). If roll 14 were allowed to counter-rotate in the opposite direction, the loose end 13 of tape 12 (See FIG. 10) could be pulled back onto roll 14, thereby creating some difficulty in starting the next taping sequence.

To prevent counter-rotation, a circular, toothed ratchet wheel 40 surrounds mandrel 26 on frame 22. The angle of the teeth 42 in the direction of desired rotation is gently sloped. The angle of the teeth 42 in the opposite (counter-rotation) direction is steep. The underside of tape carrier 32 has a small protrusion 43 that is dimensioned to ride up the gentle slope of teeth 42 in the desired direction but is not able to overcome the steep pitch of teeth 42 in the opposite direction. This is one arrangement of parts to prevent, or limit, counter-rotation of tape roll 14. Other approaches may be used in the practice of this invention.

A cutting blade 28 is mounted on frame 22 at the forward end of dispenser 10. A user of dispenser 10 is protected from unwanted contact with cutting blade 28 by shield 30 that normally extends from frame 22 in a curved arc (See FIGS. 7 and 8). When not in use or when the dispenser 10 is applying tape 12 to surface 20, the forward edge of shield 30 curves away from frame 22 so that its outer surface extends away from frame 22 a greater distance than the cutting edge of blade 28 as shown in FIGS. 7 and 8. Thus, a user's hand that might stray into an area near blade 28 is kept out of contact with blade 28 by the outer surface of shield 30.

Curvilinear shield 30 is made from a flexible material that nevertheless retains its shape when pressure on it is released, for example, polycarbonate.

When application of tape 12 on surface 20 is completed, the tape can be cut by rotating dispenser 10 as shown in FIG. 10 while pressing the dispenser down toward surface 20. This action results in contact of blade 28 with tape 12 thereby sufficiently severing the latter to allow separation of tape on surface 20 from tape in the dispenser 10. Access of blade 28 to tape 12 in this situation is facilitated by opening 31 in shield 30. As downward pressure is applied on dispenser 10, shield 30 bends toward frame 22 so that blade 28 passes through opening 31 in shield 30. The lower, outer surface of shield 30 below opening 31 also acts as a surface for burnishing or pressing the tape 12 onto surface 20.

Tape dispensers are often used to seal boxes or packages. FIG. 21 illustrates a typical orientation of tape disperser 10 when used to seal the top of box 60 with tape 12. As viewed from the end of box 60, the tape dispenser 10 (shown in phantom and solid lines) starts on the left side of the box in position X. In that position tape 12 is unrolled from roll 14 onto a portion of box 60 as it is moved up the side of the box. The dispenser 10 is moved across the top to position Y and then down the other side to position Z where the tape is cut off the roll. As the tape is dispensed the portion of shield 30 below opening 31 (shown as area B in FIG. 21) can be gently pressed against the dispensed tape 12 to improve its adherence to box 60. When the dispenser reaches position Z the dispenser is rotated and pressed against box 60. This causes shield 30 to flex inward toward dispenser 10 thereby exposing the tape 12 to cutting blade 28, which severs the tape.

Some portions of the exterior surface of handle 24 preferably contain an elastomeric coating 44 that assists a user in gripping the handle. Similar coatings can be used in other portions of the dispenser, for example, on the thumb hold 46 on the top of the dispenser.

Figure 12:
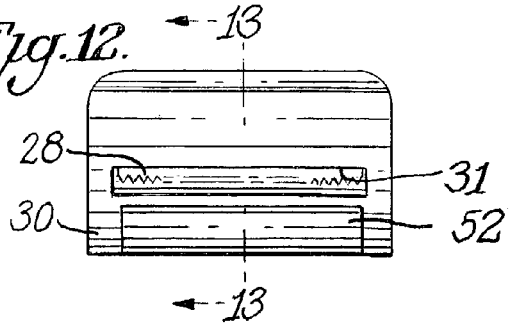
FIG. 12 is a partial front elevational view of the dispenser shield showing a static strip applied to hold the loose end of tape after cutoff.
Figure 13:
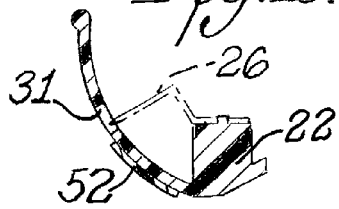
FIG. 13 is a cross-sectional, side elevational view taken along line 13—13 of FIG. 12.
Figure 14:
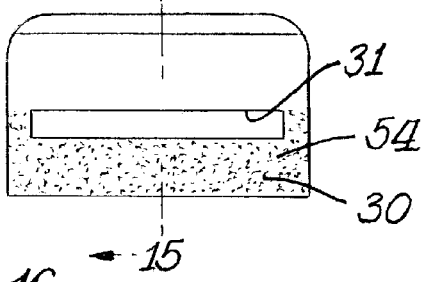
FIG. 14 is a partial front elevational view of the dispenser shield showing another static surface.
Figure 15:
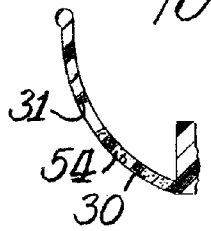
FIG. 15 is a cross-sectional side elevational view taken along line 15—15 of FIG. 14.
Figure 16:
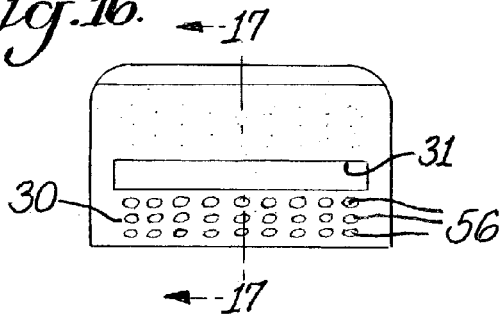
FIG. 16 is a partial front elevational view of the dispenser shield showing a dimpled suction surface used to hold the loose end of tape after cutoff.
Figure 17:
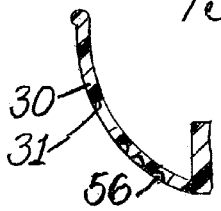
FIG. 17 is a cross-sectional side elevational view taken along line 17—17 of FIG. 16.

Management of the loose tape end 13 after it is cut from tape applied to application surface 20 is aided by at least one pair of tabs 50 on the forward end of frame 22 near the point where shield 30 is attached to frame 22. Additional control of the loose tape end 13 can be achieved with one or more tape retention features included in shield 30. One such tape retention feature is a static strip 52 mounted on the shield 30, preferably below opening 31 in shield 30 as shown in FIGS. 12–13. To promote static cling of tape 12 to shield 30, a portion can be made from carbon material 54 which better retains a static charge such as shown in FIGS. 14–15. Alternatively, the outer surface of shield 30 can be made of a soft material with dimples or depressions 56 across its surface. When the dispenser 10 is rotated into cutting position (FIG. 10) the portion of shield 30 below opening 31 is in direct pressing contact with the loose end 13 of the tape after being cut by blade 28. As the dispenser 10 is rotated counterclockwise to cut the tape 12 with blade 28, the dimples 56 are pressed against that tape and act as miniature suction cups holding the loose end 13 of tape 12 in place. Another means of managing loose end 13 of tape 12 is to coat the surface of shield 30 with a light adhesive.

Figure 19:
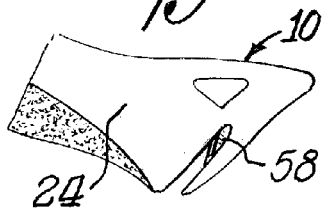
FIG. 19 is a fragmental side elevational view of the dispenser with a cutting blade built into the handle.
Figure 20:
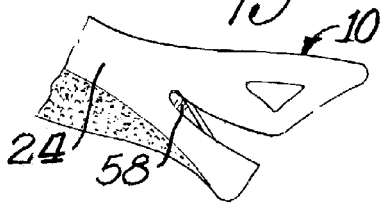
FIG. 20 is a fragmental side elevational view of an alternative arrangement for incorporating a cutting blade into the handle.

The dispenser 10 may optionally include utility blades 58 in the handle 24 such as shown in FIGS. 19–20. These blades 58 can be used for opening cartons, cutting string or other purposes. The blades are recessed within handle 24 in a manner that minimizes contact with a user of dispenser 10.

What is claimed is:

1. A hand held adhesive film dispenser comprising:

a frame carrying a roll of tape;

a handle attached to the frame;

a cutting blade extending from the frame;

a flexible, curvilinear shield extending from the frame and overlying the cutting blade to prevent user contact with the blade.

2. The adhesive film dispenser of claim 1 wherein the shield contains an opening therein aligned with the blade.

3. The adhesive film dispenser of claim 2 wherein the blade extends through the opening in the shield to cut tape when the shield is flexed toward the frame.

4. The adhesive film dispenser of claim 3 wherein at least a portion of the surface of the shield between the frame and opening therein is usable to press the tape onto an application surface.

5. The adhesive film dispenser of claim 1 wherein a surface of the shield contains deformable dimples that act as suction cups to retain a loose end of adhesive film after being cut off by the blade.

6. The adhesive film dispenser of claim 1 wherein a portion of the shield contains a material that creates static electricity to retain a loose end of adhesive film after being cut off by the blade.

7. The adhesive film dispenser of claim 1 wherein the shield includes a portion containing a mild adhesive to retain a loose end of adhesive film after being cutoff by the blade.

* * * * *

UNITED STATES PATENT AND TRADEMARK OFFICE

CERTIFICATE OF CORRECTION

PATENT NO. : 7,195,048 B2
APPLICATION NO. : 10/454000
DATED : March 27, 2007
INVENTOR(S) : Wojtkun et al.

It is certified that error appears in the above-identified patent and that said Letters Patent is hereby corrected as shown below:

Title page, (56) References Cited, FOREIGN PATENT DOCUMENTS (Continued), Page 2, delete "JP 68 047755 3/1983" and insert therefor --JP 58 047755 3/1983--.

Signed and Sealed this

Twenty-eighth Day of August, 2007

JON W. DUDAS
*Director of the United States Patent and Trademark Office*